US006128932A

United States Patent [19]

Mainetti et al.

[11] Patent Number: 6,128,932

[45] Date of Patent: Oct. 10, 2000

[54] ANTI-SHOPLIFTING SEAL

[75] Inventors: Mario Mainetti, Valdagno, Italy; Chet Kolton, Newark, N.J.

[73] Assignee: Mainetti Tecnologie S.p.A., Castelgomberto, Italy

[21] Appl. No.: 09/187,564

[22] Filed: Nov. 5, 1998

[30] Foreign Application Priority Data

Nov. 6, 1997 [IT] Italy ..... VI97A0188

[51] Int. Cl.[7] ..... E05B 65/00

[52] U.S. Cl. ..... 70/57.1; 292/307 R; 292/320

[58] Field of Search ..... 70/57.1; 292/307 R, 292/317–321

[56] References Cited

U.S. PATENT DOCUMENTS

| | | | |
|---|---|---|---|
| 2,497,434 | 2/1950 | Borland | 292/317 |
| 3,149,869 | 9/1964 | Chamberlin | 292/320 |
| 4,161,348 | 7/1979 | Ulrich | 292/307 R X |
| 4,196,424 | 4/1980 | Williamson | 70/57.1 X |
| 4,649,397 | 3/1987 | Heaton et al. | 70/57.1 X |
| 5,118,148 | 6/1992 | De Lima Castro Netto | 292/320 X |
| 5,120,097 | 6/1992 | Fattori et al. | 292/318 |
| 5,306,055 | 4/1994 | Mainetti | 292/320 |
| 5,421,177 | 6/1995 | Sieber et al. | 292/320 X |
| 5,788,294 | 8/1998 | Leon et al. | 292/307 R |
| 5,791,079 | 8/1998 | Mazzucchelli | 70/57.1 X |

FOREIGN PATENT DOCUMENTS

| | | | |
|---|---|---|---|
| 408110 | 1/1991 | European Pat. Off. | 292/307 R |
| 2043384 | 1/1979 | Germany | 292/307 R |

*Primary Examiner*—Suzanne Dino Barrett
*Attorney, Agent, or Firm*—Bucknam and Archer

[57] ABSTRACT

An anti-shoplifting seal is constituted by a rigid body provided with a flexible and/or elastic cord, the cord being provided at the end thereof with a spike. The spike after going through an opening formed in the product to be marked is inserted in a non-removable manner within the body. The seal comprises two half-bearings placed one in front of the other and joined one to the other in a manner to form an internal cavity within which there is placed a plate of a ferromagnetic material or any other material sensitive to apparatuses marking magnetic fields, radio frequency signals and other similar sources well known at the present state of technology.

7 Claims, 1 Drawing Sheet

1
2
3
4
5
6
7
8
9
10
11
12
13
14
15
16
17
18
19
20
21
22

ANTI-SHOPLIFTING SEAL

FIELD OF THE INVENTION

The present invention relates to an anti-shoplifting seal constituted by a body provided with a cord which is flexible and/or elastic and which has at its extremity a spike, the latter being capable of inserting itself within the body of the seal in a manner which is not removable.

BACKGROUND OF THE PRIOR ART

Seals are well known made in general of elastic material and used in commercial applications to distinguish a variety of products. These seals are constituted in general by a rigid body provided with a flexible cord which at first is made to go through an opening, such as a slot, an eye or other opening provided in the article which must be marked and therefore anchored in a non-removable manner. The identification of the several articles is made by printing on the body of the seal specific data of the article such as the name or the nameplate of the party who produces the articles, the hoisting tackle, the code with bars and similar data. At present in commerce there are used seals made in great variety of shapes, dimensions and systems of reciprocal binding between the body and the flexible cord. By way of example, European Patent 0497795 should be mentioned because there is illustrated a seal comprising a perimetrical frame of rectangular shape made of thermoplastic material and provided with an internal cavity. On the body of the frame there is buried a small flexible cord which comes out from at least one of the two smaller sides and is provided at its ends with a spike which is going to be inserted in a non-removable manner on a corresponding opening made on the same side of the body.

SUMMARY OF THE INVENTION

One object of the present invention is to provide a seal which offers a shape such that it allows to carry out the production in series very rapidly, which may be produced with simple and automatic apparatuses in such a manner that the final cost of each individual piece is minimal.

Another object of the invention is to provide the seal with a marking element which is not visible externally in such a manner as to discourage shoplifting by customers in stores, storehouses, supermarkets and similar places.

A third object of the invention is to provide a seal which has a pleasant external appearance and which allows to vary rapidly and economically the external appearance in conformance with the requirements of the people who use the mark.

These objects and others which will appear more clearly from the following description are achieved substantially by making a body preferably of a plastic material constituted by two half bearings placed one against the other and joined reciprocally in a non-removable manner on one of which is buried or glued or mechanically blocked a flexible cord provided with a spike, while in the internal cavity of the body there is placed a magnetic lamina which constitutes the antishoplifting element. A possible embodiment of the invention provided herein by way of illustration and not intended to limit the invention is described hereinbelow by reference to the attached drawings of which:

Figures 1, 2, 3, 4:
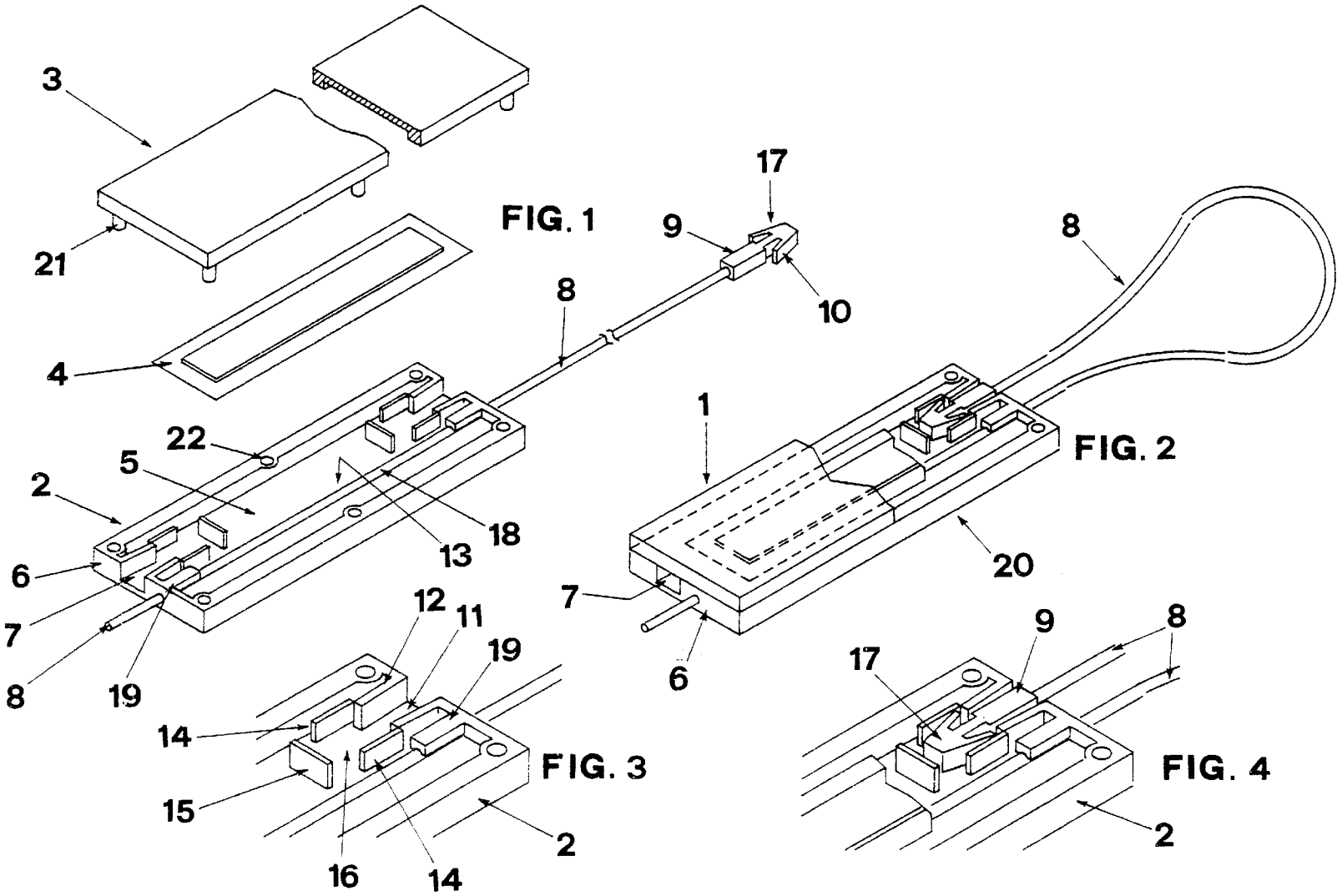
FIG. 1 is a perspective exploded view of the seal of the invention.
FIG. 2 is a perspective view partially in cross section of the seal of the invention in the assembled state in conditions to be utilized.
FIG. 3 is a view in particular of the area of free hooking.
FIG. 4 is a view in detail of the hooking area after hooking.

As shown in the figures, seal (1) comprises in the embodiment shown in FIG. 1 a lower half-bearing (2) and an upper-half-bearing (3) both with the same external profile substantially rectangular and a ferromagnetic plate (4) which is inserted in the internal cavity (5) formed by the two above described half-bearings after they have been reciprocally joined.

On at least one of the two smaller. sides (6) of the lower half bearing (2) there is an opening (7) which puts in communication the exterior with the internal cavity (5).

The lower half-bearing (2) in addition is crossed by a portion of a flexible cord (8) which exits on at least one of the two smaller sides in proximity of the same opening (7).

On at least one of the two extremities of the flexible cord (8) is applied a spike (9) which is provided with flexible tongues (10). The spike (9) is capable to be inserted in an irreversible manner in the opening (7) of the lower half-bearing (2).

As shown particularly in FIG. 3, the opening (7) is prolonged towards the interior of the cavity assuming the configuration of a converging channel (11), the channel being limited by the walls (12) which lay on the base (13) of the half-bearing (2), the section of passage of the latter being smaller with respect to the space occupied by the spike (9).

Again on the base (13), corresponding to the internal part of the channel (11), are located two lateral ribs (14) and a frontal projection (15) which limit the space (16) in which the anterior part (17) of the tongues of the spike (9) is going to be placed when the same spike is inserted in the body of the seal while the ribs serve as support base for the ferromagnetic plate (4).

The ribs (14) are also placed in contact with the walls (12) so that they serve also as a reinforcing element of the entire converging channel (11) and avoid deformation of the latter during the coupling of the spike.

The portion (18) of the flexible cord (8) contained in the interior of the lower half-bearing (2) is laterally blocked by means of clews (19) and is partially or totally buried or glued or mechanically locked on the base (13).

As shown in FIG. 4 the non-removable hooking of the spike (9) to seal (1) is accomplished by means of the elastic deformation which the flexible tongues (10) undergo when spike (9) goes through the converging channel (11) and returns to the initial conditions when the tongues have gone through the channel.

It is clear that this hooking action is possible also with a spike having only one flexible tongue placed laterally and this action is particularly advantageous when it is applied to seals made of a rigid material.

The joining of the two half-bearings (2) and (3) so as to constitute a unique body (20) may be obtained with a glue or soldering under the action of ultrasound material or by means of a fixed joint preferably of the dovetail type and the effectiveness of the joint may be improved by the presence of projections (21) which are located on the upper half bearing (3) and due to the complementary seats (22) which are located along the perimetrical border (23) of the lower half-bearing (2).

The seal according to the invention if it is manufactured of a thermoplastic material, for instance polystyrene, polypropylene and similar products requires the use of very simple dies in order to obtain the two separate half-bearings. The flexible cord (8) is placed in a first die which comprises the impression of the lower half-bearing (2) and the impressions of two spikes (9) in such a manner that the cord goes through completely the impressions. Then the die is closed and the plastic material is injected into the cavity thus formed.

The die to prepare the lower half-bearing (2) is constituted by two simple punches which form the internal cavity (5) and which during the injection phase hold the portion (18) of the flexible cord (8) squashed against the base (13) of the cavity. At the end of the injection phase, the die is opened and the flexible cord (8) with the lower half-bearing (2) and the spikes (9) is caused to advance along the die of a length essentially equal to the length of the cord in conditions of the assembled seal so that it is wound on a bobbin.

The die is closed for a new phase of injection and this operation is continued up to the time when a bobbin completely wound by the continuous cord (8) cannot be obtained any longer, the lower half-bearings (2) being joined at regular intervals alternated in couples or individual spikes (9).

The die to prepare the upper half-bearing (3) is substantially simpler because it must prepare the individual plates which are substantially planar and which after they have been made may be subjected to the conventional procedures of decoration prior to being applied so finished on the lower half-bearing (2) and being joined to it in a stable manner with conventional methods.

The application of the upper half-bearing (3) to the lower half-bearing (2) may be carried out manually and automatically by the people who prepare the product or more advantageously may be carried out by the party who utilizes the two half-bearings so that in this manner a single bobbin is required with the lower half-bearings (2) joined to the cord (8) and to different types of upper half-bearings (3) in order to obtain in this manner seals which are in conformance with the market requirements.

On the basis of what has been described hereinabove and independently from the particular embodiments described, the seal (1) of the present invention offers several advantages with respect, to known seals in particular:

It may be obtained with a simple production cycle which allows significant production rates and minimal production costs;

It allows to simplify both the production as well as the distribution of the articles because a unique lower half bearing (2) is obtained and the seal may be personalized by varying the half-bearing (3) or the upper plate.

What is claimed is:

1. An anti-shoplifting seal comprising:

a) a rectangularly shaped lower half-bearing (2) having two smaller sides (6) and together with a base (13) defining a cavity (5) therein, an opening (7) formed in one of said smaller sides (6) as a channel (11) with converging walls (12), a pair of lateral ribs (14) connected to said walls (12) at the interior of said channel so as to reinforce the same and a projection (15) which defines with said ribs a space (16), said walls (12), ribs (14) and projection (15) being formed on said base (13);

b) a flexible cord (8) extending along the entire length of said lower half bearing and exiting at one of said smaller sides (6) and having a spike (9) at an extremity thereof, said spike (9) having at least one flexible lateral tongue (10) and being adapted for insertion into said opening (7) so that said at least one tongue engages said walls (12) to retain said spike therein and the anterior part (17) of said at least one tongue is disposed in said space (16);

c) a ferromagnetic plate (4) disposed in said cavity (5) and supported therein by said ribs (14); and d) an upper half-bearing (3) adapted to be joined with said lower half-bearing (2) so as to cover said cavity (5) and said channel (11).

2. The seal according to claim 1 wherein said channel (11) has a section of passage, two tongues are present, said spike and said tongues have dimensions and said section of passage is slightly smaller with respect to said dimensions of said spike (9) provided with tongues (10).

3. The seal according to claim 2 wherein said cord (8) has a portion (18) contained in the interior of said lower half-bearing (2) and said portion (18) is blocked laterally by clews (19), said clews (19) being integral with the body of said half-bearing (2).

4. The seal according to claim 3 wherein said portion (18) of said flexible cord (8) is totally or partially buried or glued or blocked mechanically on said base (13).

5. The seal according to claim 1 wherein said joint between said two half-bearings (2,3) is obtained by means of projections (21) and complementary seats (22) provided on the border of union of said half-bearings (2) and (3).

6. The seal according to claim 1 wherein said two half-bearings (2,3) are made of plastic material.

7. The seal according to claim 1 wherein said spike (9) is made of plastic material.

* * * * *